United States Patent [19]

McDonald

[11] 4,313,525

[45] Feb. 2, 1982

[54] CAR DOOR SAFETY INTERLOCK

[75] Inventor: Emory W. McDonald, Geneseo, Ill.

[73] Assignee: Montgomery Elevator Company, Moline, Ill.

[21] Appl. No.: 156,771

[22] Filed: Jun. 5, 1980

[51] Int. Cl.[3] ..... B66B 13/00

[52] U.S. Cl. ..... 187/57; 49/120

[58] Field of Search ..... 187/51, 52 LC, 57, 59, 187/61; 49/116, 120, 122

[56] References Cited

U.S. PATENT DOCUMENTS

| | | | |
|---|---|---|---|
| 1,326,440 | 12/1919 | Chaudoir . | |
| 1,531,428 | 3/1925 | Way | 187/61 |
| 2,067,242 | 1/1937 | Norton | 187/57 |
| 3,659,677 | 5/1972 | Shalders | 187/61 |
| 3,721,319 | 3/1973 | Hall et al. | 187/61 |
| 3,912,049 | 10/1975 | Holland et al. | 187/61 |

OTHER PUBLICATIONS

Moline Accessories Corp., Form #211, p-13002 Interlock, Published after Apr. 14, 1970.

Moline Accessories Corporation, Form #161, "#104 Hatch Door Drive and Interlock Adjustment Data", (5-12-71), Revision of drawings first published in 1961.

Moline Accessories Company catalog sheet titled "Interlock and Retractible Mechanical Door Clutch", published in Jun. of 1970.

*Primary Examiner*—David A. Scherbel
*Assistant Examiner*—Kenneth Noland
*Attorney, Agent, or Firm*—Wegner, Stellman, McCord, Wood & Dalton

[57] ABSTRACT

The power operated sliding door of an elevator car is provided with a mechanical safety interlock which permits the car door to be moved more than a critical distance from its closed position only when the car is in a landing zone. A pivoted interlock hook on the car door has a normal position in which it engages an interlock lug on the car frame when the door moves the critical distance from closed position. A movable element on the car door is driven to move the hook to a clearance position relative to the interlock lug. Drive of the movable element occurs when it contacts an interengaging member on the hatch door as the car door first starts to move from closed position in a landing zone.

8 Claims, 2 Drawing Figures

11
12
14
13
27
30
26
25
31
38
29
16
22a
16a
15
40b
33
40a
34
22
17
22b
21
10
36
C
35
37
39
20
18
19
23
24

11
14
27
38
25
30
31
26
28
11
13
12
12
16
16a
15
40b
33
40a
32
10a
17
34
C
21
18
23
24
19
36
10
34
35
37
39
20

CAR DOOR SAFETY INTERLOCK

BACKGROUND OF THE INVENTION

One of the most persistent and difficult problems in the elevator industry is the safety of passengers in an elevator that stalls between floors because of a power failure or equipment breakdown. Passengers may become panicky and attempt to open the car door; and in some instances those efforts are successful. This can create a very dangerous condition, because passengers may be injured attempting, for example, to crawl through a space between a floor landing and the top of the elevator car doorway when the car is a few feet below a floor level, or through a small space between the car floor and the top of a hatch entranceway when a car is a few feet above a floor level.

In keeping with present consumerist endeavors to protect the individual even from the consequences of his own folly, some municipalities have now enacted, or are considering, amendments to their elevator codes to require that an elevator car door be locked, so that it cannot be opened from inside the car, whenever the elevator is outside a landing zone. Such requirements have received the endorsement of elevator industry code and safety committees.

SUMMARY OF THE INVENTION

The present invention provides a simple and effective means for locking an elevator car door except when the elevator is in a landing zone. The invention, of course, is applicable to automatic elevators which have the conventional power operated sliding elevator door which is clutched to a hatch door when the elevator car is at a landing so that the door operating mechanism opens and closes the hatch door with the car door. The invention is applicable to single and double car and hatch doors.

In accordance with the invention, a fixed interlock lug is positioned on the car frame above the car door. An interlock hook is pivotally mounted on the car door so as to have a normal position in which it engages with the lug when the car door is moved a critical distance from closed position toward open position. The critical distance is one which creates a space between the edge of the car door and the door frame which is too small for a passenger in the car to put his fingers through. A movable element on the car door operatively engages the interlock hook so that movement of the element moves the hook from its normal position to a clearance position relative to the interlock lug; and element driving means on the car door contact the interengaging means on a hatch door when the car door has moved only a part of the critical distance, with the element driving means being thereafter moved by the contact with the interengaging means to move the element and the hook before the car door moves the rest of the critical distance. This permits the car door to be moved more than the critical distance only when the car is in a landing zone, since that is the only area in which the element driving means can contact the interengaging means on a hatch door.

THE DRAWINGS

FIG. 1 is a fragmentary front elevational view of a part of a hatch door and an elevator car door, illustrating parts of the car door and hatch door operating mechanism which cooperate with the safety interlock mechanism of this invention, and with the parts of the safety interlock mechanism in the positions that they occupy when the elevator car is not in a landing zone; and FIG. 2 is a view like FIG. 1 with the parts of the present mechanism in the positions that they occupy when the car is at a landing zone and the door has started to open.

DETAILED DESCRIPTION OF THE INVENTION

Figure 1:
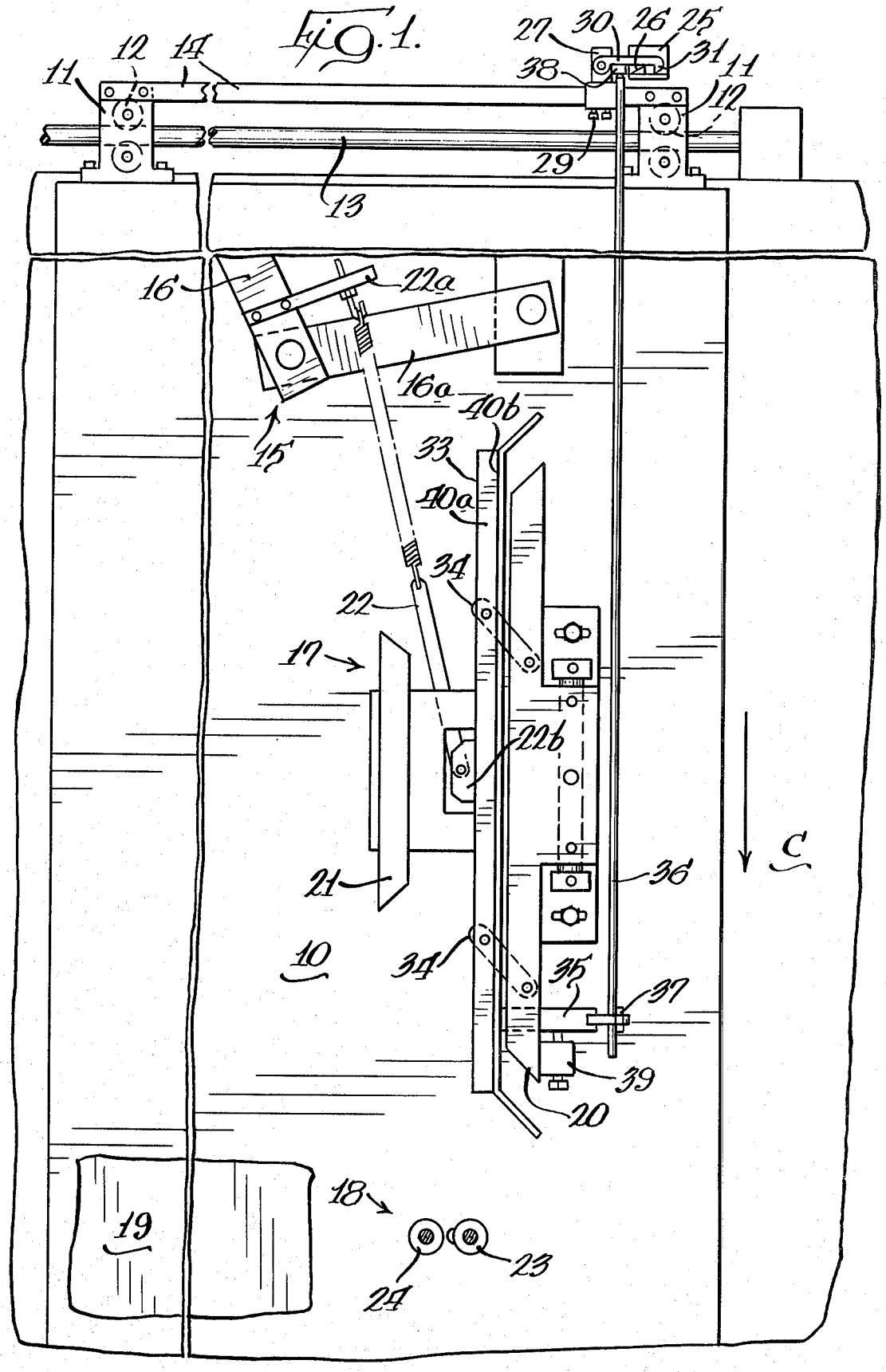

Referring to the drawings, an elevator car door, indicated generally at 10, has spaced hanger brackets 11 that have rollers 12 which support the car door for sliding movement on a track 13 which is mounted upon the elevator car C. A top rail 14 connects the brackets 11.

The car door 10 is opened and closed by an operating mechanism, indicated generally at 15, which includes a drive arm 16 operatively connected to a drive motor and power train (not shown) which is supported on top of the elevator car in the usual way. A link **16*a* connects the arm 16 to the car door 10**.

Mounted upon the front face of the car door are parts of interengaging means, indicated generally at 17, which cooperate with interengaging means, indicated generally at 18, which are mounted upon a hatch door 19. The interengaging means 17 upon the car door and 18 upon the hatch door cooperate to open and close the hatch door in unison with the car door when the elevator car is stopped in a landing zone. The interengaging means 17 include a stationary clutch blade 20 mounted upon the door and a retractable clutch blade 21 which is also mounted upon the door. The retractable clutch blade 21 is moved from a position substantially abutting the front of the car door 10 outwardly toward the hatch door 19 by a mechanism which includes a spring and rod assembly, indicated generally at 22, which is connected at its upper end to a bracket **22*a* upon the door operating arm 16 and at its lower end to an anchor 22*b* by which is operatively associated with the retractable clutch blade 21**.

The interengaging means on the hatch door 19 includes a movable roller 23 and a fixed roller 24, both of which project from the rear face of the hatch door into the transverse plane occupied by the stationary clutch blade 20.

The apparatus as described up to this point is part of a commercially available elevator car and hatch door operating mechanism which has been sold for many years by Moline Accessories Company, which is a division of applicant's assignee Montgomery Elevator Company. All elevators which are provided with a power operated sliding car door and a sliding hatch door have a mechanism more or less like that just described for opening and closing the two doors in unison.

Figure 2:
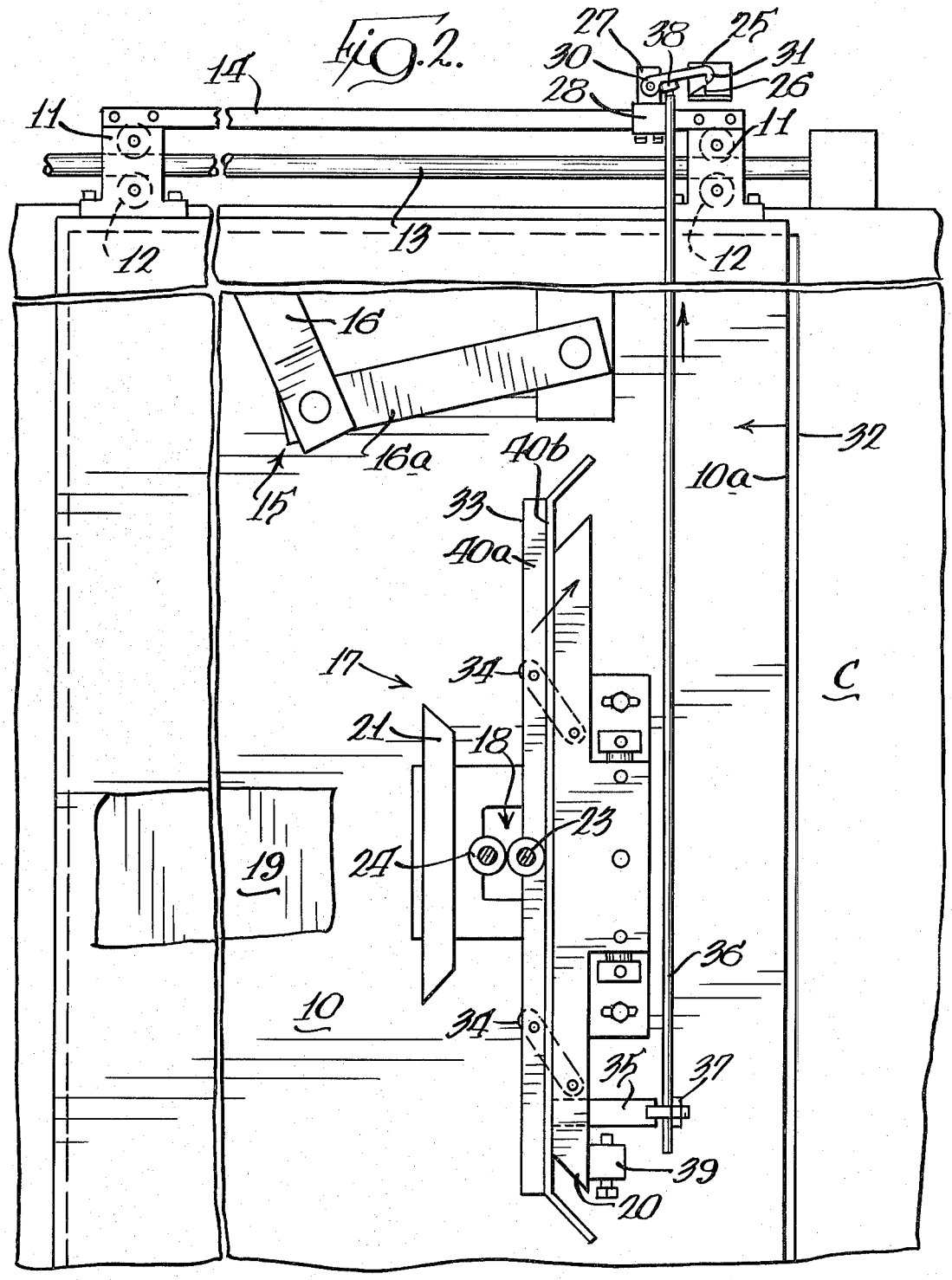

As the door operating mechanism starts to move the car door to the left as illustrated by the arrows in FIG. 2, the clutch blade 20 contacts the movable roller 23 on the hatch door 19 and moves that roller to the left to release a hatch door interlock (not shown). When the roller 23 abuts the fixed roller 24, the continued movement of the car door carries the hatch door with it; and at that time the retractable clutch blade 21 is swung outwardly by the mechanism including the spring and rod 22 so that the blade 21 is also in the same plane with the rollers 23 and 24.

When the door operating mechanism starts to close the car door, the retractable blade 21 bears upon the fixed hatch door roller 24 to return the hatch door to closed position with the car door. As the car door 10 nears a critical distance from a side 32 of the car door opening, the mechanism 22 returns the retractable clutch blade 21 to its running position substantially against the front of the car door.

The safety interlock apparatus of the present invention includes a bracket 25 which is mounted upon the elevator car above the door and carries a fixed interlock lug 26. A bracket 27 includes a slidable support 28 which is adjustably mounted upon the top rail 14 and may be fixedly secured in an adjusted position by means of set screws 29. An interlock hook 30 is pivotally mounted on the bracket 27, and in a normal position which is illustrated in FIG. 1 a lug engaging hook portion 21 is spaced from the lug 26 by a critical distance which marks the maximum travel of the car door 10 as long as the interlock hook is in the normal position of FIG. 1. The critical distance is small enough that a passenger in the elevator cannot put his fingers between the forward margin 10*a* of the car door and the side 32 of the car door opening as long as the door is opened no more than the critical distance.

The interlock hook 30 is movable from its normal position to a clearance position illustrated in FIG. 2 by the remaining parts of the safety interlock mechanism of the present invention. Those parts include a movable vane 33 which is mounted upon the stationary clutch blade 20 by means of a pair of parallel links 34, an unlocking arm 35 which is rigidly attached to the movable vane 33, and a movable element 36 in the form of an upright push rod which is mounted for vertical adjustment in a clamp 37 on the unlocking arm 35. The upper end of the push rod 36 is connected to the interlock hook 30 by a ball and socket 38. A vertically adjustable stop 39 on the stationary clutch blade 20 serves to limit downward movement of the unlocking arm 35 and thus fix the normal position of the movable vane 33.

The movable vane 33 includes a mounting web 40*a* which receives the pivots for the parallel links 34, and a roller contacting web 40*b* which is seen by the downwardly extending broken line X in FIG. 1 to clear the movable hatch door roller 23 as the elevator car moves up and down in the hatchway. The clearance between the web 40*b* and the movable roller 23 is considerably less than the critical distance, so the web 40*b* of the movable vane 33 strikes the movable hatch door roller 23 almost immediately after the car door 10 starts to move toward open position. This swings the vane 33 upwardly on the links 34 as indicated by the diagonal arrow in FIG. 2, and this elevates the push rod 36 to raise the interlock hook 30 to the clearance position illustrated in FIG. 2.

Movement of the retractable clutch blade 21 into the plane of the hatch door rollers 23 and 24 occurs only after the car door 10 has traversed the critical distance, and conversely when the doors are being closed the closing force applied through the retractable clutch blade 21 is eliminated by retraction of the clutch shortly before the doors are fully closed. The car door, being still under power, moves somewhat ahead of the hatch door which is coasting toward closed position, and this releases the pressure between the movable roller 23 and the driving vane web 40*b* of the car door interlock mechanism. As the car door closes the critical distance, therefore, the vane 33 returns to its lowered position and the interlock hook 30 returns to normal position.

The foregoing detailed description has been given for clearness of understanding only and no unnecessary limitations should be understood therefrom as modifications will be obvious to those skilled in the art.

I claim:

1. In an automatic operating mechanism for a power operated sliding door of an elevator car which travels in a hatchway that has a sliding hatch door at each landing, there being interengaging means on the car door and on each hatch door so that opening and closing of the car door at a landing also opens and closes the hatch door at said landing, a mechanical safety interlock to permit the elevator car door to be moved more than a critical distance from its closed position only when the elevator car is in a landing zone, said safety interlock comprising, in combination:

a fixed interlock lug on the car frame above the car door;

an interlock hook pivotally mounted on the car door, said hook having a normal position when the car door is closed in which a lug engaging portion thereof is aligned with said lug and spaced from the lug by said critical distance;

a movable element on the car door which operatively engages the interlock hook so that movement of said element moves said hook from said normal position to a clearance position in which its lug engaging portion is out of alignment with the interlock lug;

and element driving means mounted on the car door in a position to contact the interengaging means on a hatch door when the car door has moved part of said critical distance, said element driving means being thereafter moved by said contact with said interengaging means to move said element and thereby move the hook to its clearance position before the car door moves the rest of the critical distance, whereby the car door can be moved more than said critical distance only when the car is in a landing zone.

2. The combination of claim 1 in which the movable element is in an upright push rod which is movable endwise to raise the hook.

3. The combination of claim 2 in which the push rod engages the under side of the hook and is moved up to raise the hook.

4. The combination of claim 2 in which the element driving means comprises an upright vane supported on a pair of parallel links for swinging movement in a vertical plane, contact of said vane with said interengaging means on a hatch door swings said vane on said links, and said swinging movement moves said push rod endwise.

5. The combination of claim 4 which includes an arm on the vane, and in which the push rod is supported on said arm.

6. The combination of claim 4 or claim 5 which includes a clamp in which the push rod is mounted for vertical adjustment.

7. The combination of claim 2 in which the point of engagement of the push rod with the interlock hook is much closer to the hook pivot than is the lug engaging portion of the hook, whereby a small movement of said push rod raises the lug engaging portion of the hook a substantial distance.

8. The combination of claim 1 in which the point of engagement of the movable element with the interlock hook is much closer to the hook pivot than is the lug engaging portion of the hook, whereby a small movement of said movable element raises the lug engaging portion of the hook a substantial distance.

* * * * *